US007427085B2

(12) United States Patent
Sio

(10) Patent No.: US 7,427,085 B2
(45) Date of Patent: Sep. 23, 2008

(54) CATCH

(76) Inventor: Yeok Sing Sio, Block 465, #07-1054, Ang Mu, Kio Avenue 10, Singapore (SG) 560465

( * ) Notice: Subject to any disclaimer, the term of this patent is extended or adjusted under 35 U.S.C. 154(b) by 69 days.

(21) Appl. No.: 10/821,365

(22) Filed: Apr. 9, 2004

(65) Prior Publication Data

US 2004/0207216 A1 Oct. 21, 2004

Related U.S. Application Data

(63) Continuation-in-part of application No. 10/069,211, filed as application No. PCT/SG00/00122 on Aug. 23, 2000, now abandoned.

(30) Foreign Application Priority Data

Aug. 23, 1999 (SG) ..... 9904110-5

(51) Int. Cl.
*E05C 19/06* (2006.01)

(52) U.S. Cl. ..... 292/87; 292/19

(58) Field of Classification Search ..... 292/13, 292/19, 20, 81, 11 A; 24/DIG. 50, DIG. 39, 24/DIG. 40
See application file for complete search history.

(56) References Cited

U.S. PATENT DOCUMENTS 2,133,687 A 4/1938 Grace
2,873,880 A 2/1959 Poulos
2,914,936 A 12/1959 Reinold
3,050,322 A * 8/1962 Miller ..... 292/114
3,160,431 A 12/1964 Anderson
3,682,163 A 8/1972 Plummer
3,822,905 A 7/1974 Bell
3,971,580 A * 7/1976 Tantlinger et al. ..... 292/201
4,068,872 A * 1/1978 Smith ..... 292/87
4,216,984 A 8/1980 Hofmann
4,653,783 A * 3/1987 Steup ..... 292/19
4,725,084 A 2/1988 Catricola
5,641,186 A 6/1997 Ross
5,647,618 A 7/1997 Lamberth
5,975,593 A * 11/1999 Cress ..... 292/86
6,446,824 B1 * 9/2002 Sluiter ..... 220/6

FOREIGN PATENT DOCUMENTS

| | | |
|---|---|---|
| CH | 649602 | 5/1985 |
| DE | 8430945 | 9/1989 |
| EP | 0508750 | 10/1992 |
| FR | 2414108 | 8/1979 |

* cited by examiner

*Primary Examiner*—Gary Estremsky
(74) *Attorney, Agent, or Firm*—D. Peter Hochberg; Sean F. Mellino; Daniel J. Smola

(57) ABSTRACT

A catch for articles such as sliding or hinged doors, windows, grilles of a swing opening member, the articles having a catch for preventing their unauthorized opening. The catch has inter-engaging projections which are mounted on flexible shafts, so that if the sliding members are pried apart, the flexible shafts deform and the projections remain engaged and prevent unauthorized opening of the sliding article.

13 Claims, 9 Drawing Sheets

CATCH

CROSS REFERENCE TO RELATED APPLICATIONS

This application is a continuation in part application of application Ser. No. 10/069,211, filed Feb. 22, 2002, now abandoned which is the National Stage of International Application No. PCT/SG00/00122 filed Aug. 23, 2000.

BACKGROUND OF THE INVENTION

1. Field of the Invention

The present invention relates to the field of catches. More specifically, the present invention relates to the field of catches for doors (sliding or hinged), windows, drawers, grilles, and other furniture or apparatus which open and close and can be secured in a closed position.

2. Description of the Prior Art

Sliding members such as doors, drawers, windows, etc. suffer from the problem that they can often be easily forced opened by prying the sliding members apart. This problem is also encountered in hinged doors, windows, etc., as these are also prone to opening by prying open the catch or lock mechanism which secures the hinged door or window.

Previously, security devices have been suggested for sliding doors, windows, grilles, etc. which prevent the sliding panels from being pulled apart to a certain extent. For example, Australian patent AU-27145/95 discloses a device which has inter-engaging teeth which partially prevent sliding grilles from being pried apart. However, under severe or sustained force these teeth will break, rendering the security devices useless, and allowing the grilles to be separated.

SUMMARY OF THE INVENTION

The present invention addresses the above problems and, in a first aspect, provides a catch assembly for securing first and second members, the assembly comprising first and second catch members attachable to the first and second members respectively, each catch member having a projection portion located on a shaft, the projections of the first and second catch members being engageable with one another when the first and second catch members are in a locked position, the first and second shaft portions being flexible, such that as the members are moved apart or together when the catch members are in the locked position, the shafts flex to keep the projections engaged with one another.

As the first and second members are moved or pried apart, the shaft of each catch member generally flexes away from the member to which it is attached. The provision of the flexible shafts allows the catch to withstand a greater force prying the first and second members apart than the force withstood by prior art devices.

As the first and second members are moved or forced apart, the catch members, or preferably the shafts of the catch members, elastically deform to keep the projections engaged. The shafts of the catch members preferably flex to keep the projections engaged as the first and second members are moved apart or even as they are moved or pushed together. The catch members or shafts will deform elastically up to a point then, when they reach the point often called the elastic limit, they will preferably plastically deform. This plastic deformation, in which the catch members or shafts plastically deform or become permanently misshapen and unable to return to their original shape and size, is used advantageously to provide a secure catch.

Preferably, the catch members or at least the shafts of the catch members will comprise metal or plastics. More preferably, they will comprise at least one of the following UPVC, aluminum, iron or stainless steel. A material with a Young's modulus of preferably at least $62GNm^{-2}$ ($9\times10^6$ psi) is required, more preferably at least $103GNm^{-2}$ ($15\times10^6$ psi), even more preferably at least $138GNm^{-2}$ ($20\times10^6$ psi).

The above materials or materials with the above elastic properties also satisfy the plastic deformation properties preferably required by the present invention. For example, aluminum 6061-T6 has a Young's modulus of $70GNm^{-2}$ ($10.2\times10^6$ psi), ductile Iron is between 170 and $176GNm^{-2}$ and stainless steel 18.8 is $190GNm^{-2}$ ($27.6\times10^6$ psi). In general, a force of more than double these values is required to cause plastic deformation.

As the first and second members are moved apart or pushed together, the shafts preferably are capable of moving through at least 25 degrees from their rest position as they flex; more preferably, the shafts can move through at least 30 degrees from their rest position.

If the first and second members are being moved apart, for example, if they are pried or forced apart, the separation between the first and second members increases and the shafts flex to maintain the contact between the projections. As the separation between the first and second members becomes larger, it is difficult to maintain application of a strong prying force. For example, if the shaft's flex is more than 25 degrees, it is very difficult to apply an effective prying force.

Preferably, the shaft is "L" shaped. One end of this shaft is connected to the member and the projection is located at the other end of the shaft, i.e. the free end. As the shafts flex, preferably, the angle at the corner of the "L" shape varies, for example, it increases if the members are pulled apart. If the first and second members are pushed together, the angle at the corner of "L" should also increase. More preferably, the first and second catch members are positioned so that they can slide easily over one another when the members are in an unlocked position and engage with each other when the members are in a locked position.

Of course, the shaft does not need to be L-shaped, it could be curved.

The members may be provided with a plurality of catches. Preferably, such catches extend along a whole length of the member to strengthen the entire sliding assembly against unauthorized opening of the doors, grilles, windows, etc. Also, if one of the catches opens, the remaining catches will hold the first and second members together.

The provision of a plurality of catch members provides far greater security than a single catch or the prior art devices. If the members are pulled apart at a certain point such that they plastically deform at that point, the other members which were not pried apart will remain in their rest position. This line of catches where some of the members are permanently plastically deformed and others are not, gives rise to an irregular line of catches (a wave-like structure) which prevents opening of the first and second members. It is not possible to bend the catches which have been permanently deformed back into position without bending another catch out of position. Also, the catch which has deformed will further deform in an attempt to straighten it by moving the first and second members. In the sliding member assembly, one or both of the first and second members may be slidable.

The first and second members to which the catch members are attached can be members which slide relative to one another, for example, the first and second members may be sliding doors. Alternatively, the second member may be a fixed member and the first member may slide relative to the second member, for example, the second member may be a door post, window frame, or drawer support, and the first member may be a door, sliding window, or drawer respectively.

Thus, in a second embodiment, the present invention provides a sliding member assembly comprising first and second members wherein at least one member slides relative to the other member and a catch assembly, the catch assembly comprising first and second catch members attachable to the first and second members respectively, each catch member having a projection portion located on a shaft, the projections of the first and second catch members being engageable with one another when the first and second catch members are in a locked position, the first and second shaft portions being flexible, such that as the members are moved apart or together when the catch members are in the locked position, the shafts flex to keep the projections engaged with one another.

In the case where the two members slide relative to each other, at least one of the members may be substantially planar, and at least one of the catch members may be attached to the planar face of one of the members which faces the other of the first and second members.

Also, one of the catch members may be attached to the edge or close to the edge of one of the members.

In a preferred arrangement, two catch members, on opposite sides of the first sliding member, are provided, each of the catch members of the sliding member being engageable with catch members located on one or two second members.

Alternatively, the catch may be used with hinged or so-called swing doors, windows or the like. In this type of arrangement, the second member is attached with hinges or in a hinged manner to a fixed member such as a door frame, etc. The door/window assembly locks by securing the second member to a first member.

Thus, in a third embodiment, the present invention provides a hinged member assembly comprising first and second members, wherein the first member is a hinged member and is capable of being secured in a closed position to the second member, the assembly further comprising a catch assembly for securing the first and second members together, the catch assembly comprising first and second catch members attachable to the first and second members respectively, each catch member having a projection portion located on a shaft, the projections of the first and second catch members being engageable with one another when the first and second catch members are in a locked position, the first and second shaft portions being flexible, such that as the members are moved apart or together when the catch members are in the locked position, the shafts flex to keep the projections engaged with one another. In the hinged member assembly, one or both of the first and second members may be hinged.

When in the locked position, the first and second members may be separated only by a small distance. Hence, large instruments cannot be used to pry open the two members. Preferably, the minimum distance between the first and second members is twice the size of the catch members, allowing the catch members to move over one another when in an unlocked position. Preferably, the first and second members will be at least 4 mm apart, possibly at least 10 mm apart.

Preferably, the arrangement further comprises a lock member which moves the first and second catch members into the locked position. In the locked position, the projections of the first and second catch members inter-engage. Thus, in order to lock the catch members, the projections must be brought into contact. The lock member may affect movement of the catch members themselves. Alternatively, it could cause movement of the first and second members as well as the catch members.

As previously mentioned, preferably a plurality of catch members are provided. In this situation, it is preferable if at least one catch is orientated in a first orientation, and at least one other catch is oriented in a second orientation.

More preferably, the first orientation is opposite to the second orientation. This has the advantage that regardless of which sides of the catch are pried apart, the plurality of catches will still hold the device or the members together.

Advantageously, there may be a plurality of catches with the first orientation and a plurality of catches with the second orientation, the catches having the first orientation being alternatively arranged with the catches having the second orientation.

The catch assembly can be fitted to the first and second members via glue, nails, screws, etc. Alternatively, the catch members may be integral with at least one of the first and second members. The catch members could also clip, for example, to an edge of the first and/or second members.

BRIEF DESCRIPTION OF THE DRAWINGS

The present invention may take physical form in certain parts and arrangement of parts, a preferred embodiment of which will be described in detail in the specification and illustrated in the accompanying drawings which form a part hereof, and wherein.

DETAILED DESCRIPTION OF THE PREFERRED EMBODIMENT

Figure 1:
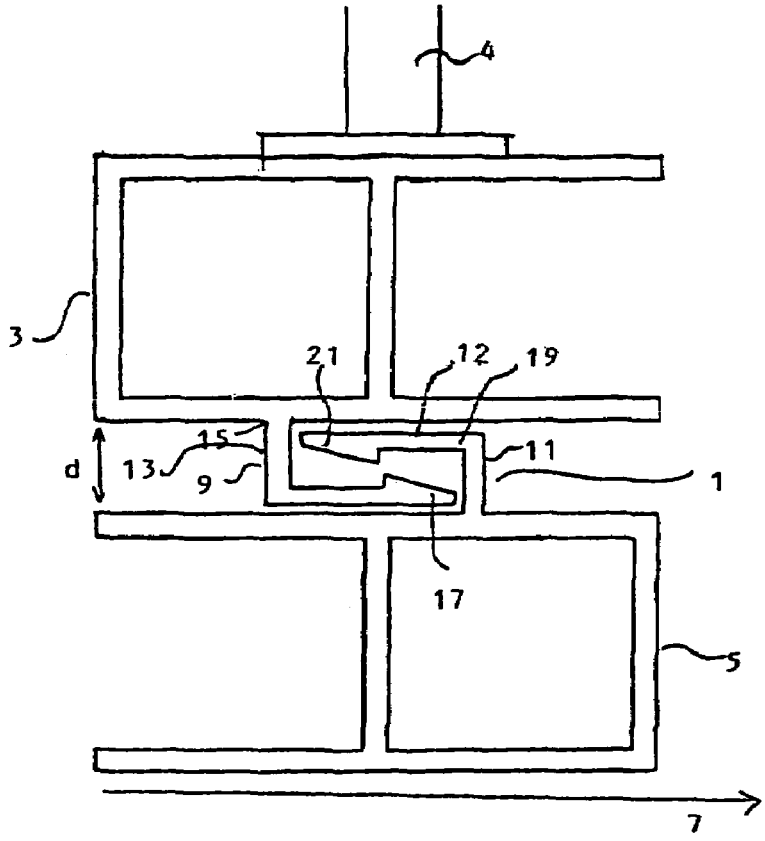
FIG. 1 shows an embodiment of the present invention with a catch in an open position.

FIG. 1 shows a catch 1 which is attached to a first member 3 and a second member 5. The second member 5 is slidable in a first sliding direction 7 relative to the first member 3. The catch 1 has a first catch member 9 and a second catch member 11. The first catch member 9 has an L shaped shaft 13 which is integral with the first sliding member 3 at one end 15. Located at the other end or free end of shaft 13, is a first projection 17 which is also integral with shaft 13.

Similarly, second catch member 11 comprises an L shaped shaft 19 and a second projection 21. The second catch member 11 is similar in construction to the first catch member 9, but is rotated through 180 degrees to the first catch member 9. The distance (d) between the first member 3 and the second member 5 is such that the second member 5 can freely slide in the first sliding direction 7 relative to the first member.

In FIG. 1, the catch is shown in the unlocked position, i.e. the projections 17, 21 are not inter-engaged with each other. The catch may be moved into the locked position by a lock member 4. In this particular example, lock member 4 acts to pull the first catch 9 towards itself such that the projections 17 and 21 inter-engage. Alternatively, lock member 4 could work by pushing the elongate part 12 of shaft member 11 away from the lock member 4. This also allows the first and second projections 17 and 21 to engage.

Figure 2:
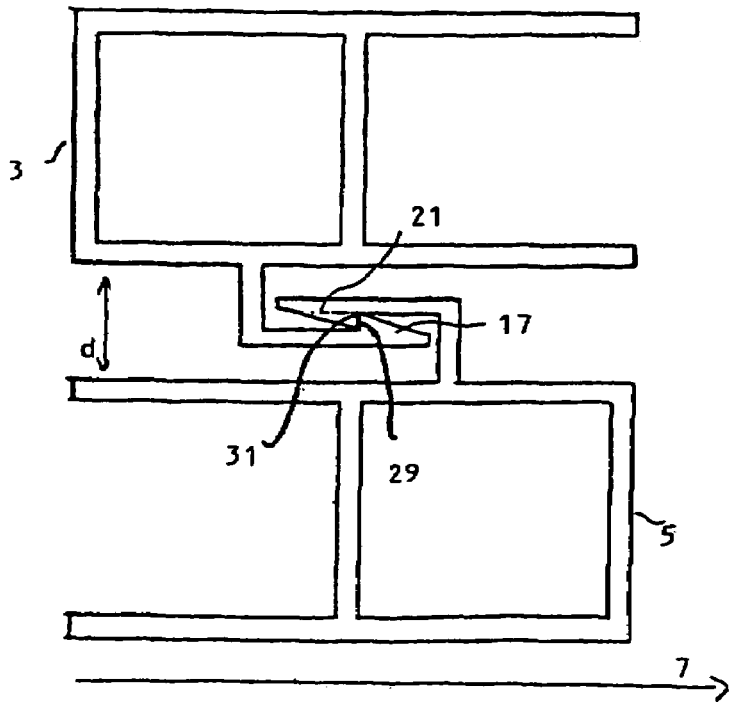
FIG. 2 shows the embodiment of FIG. 1 with the catch in a closed position.

FIG. 2 shows the catch member in its locked position. The lock member 4 is not shown here, the separation distance (d) between the first member 3 and the second member 5 is increased such that the first and second projections 17, 21 engage with one another. Inner surfaces 29, 31 of the two projections 17, 21 abut one another such that the second member 5 cannot be moved along first sliding direction 7. Hence the sliding assembly is in a locked position.

Figure 3:
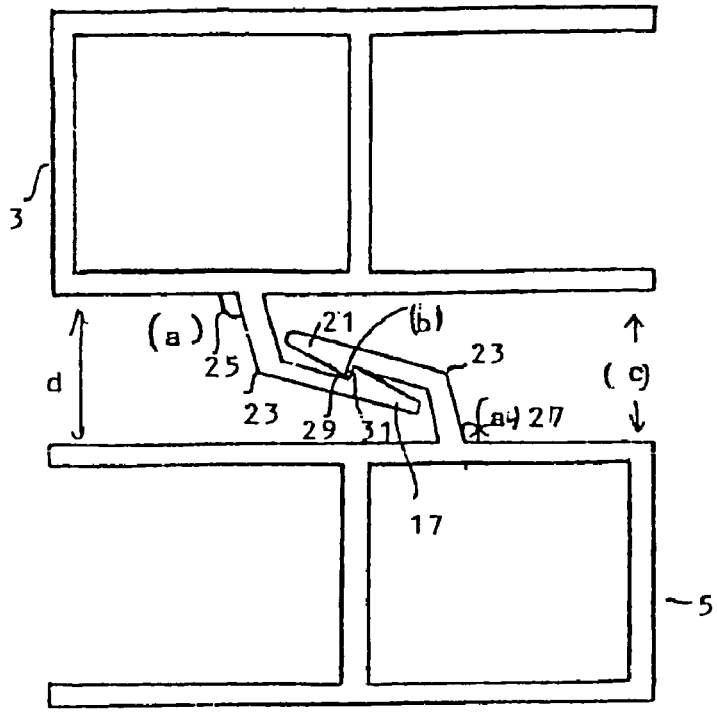
FIGS. 3 and 3*a* show the catch of FIGS. 1 and 2 when the members are pried apart.

FIG. 3 shows the arrangement of FIG. 2 where the first member 3 and the second member 5 are pried apart to extend the separation distance (d). In this forced position, the angle 23 of the L shaped first and second shafts 13, 19 extends to greater than 90 degrees. Also, the outside angle 25, 27 at which the first 13 and the second 19 shafts respectively meet the first 3 and second 5 members also extends to more than 90 degrees. In this strained position, the abutting surfaces 29, 31 of the projections 17, 21 still engage with each other. Hence, the catch members 9, 11 still remain locked in the position holding the sliding assembly together.

Figure 3A:
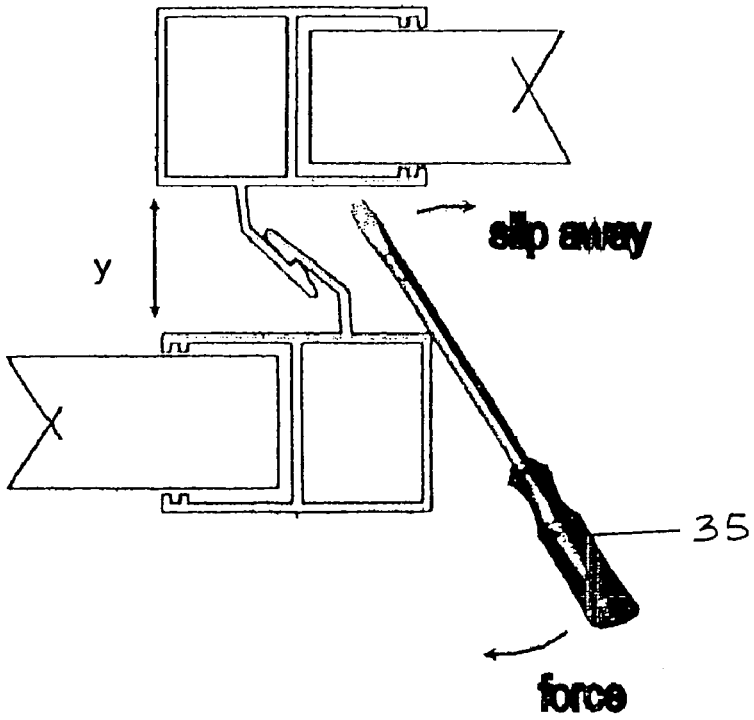

FIG. 3*a* also shows an arrangement of FIG. 2 and includes a screwdriver 35 prying apart the first member 3 and the second member 5 to extend a distance (y). Here, if the catch is moved by more than 25 degrees, the screwdriver, or other tool, will slip away and the catch will continue to be in a locked position. The locked position of the catch will make it very difficult to apply an effective prying force.

Figure 4:
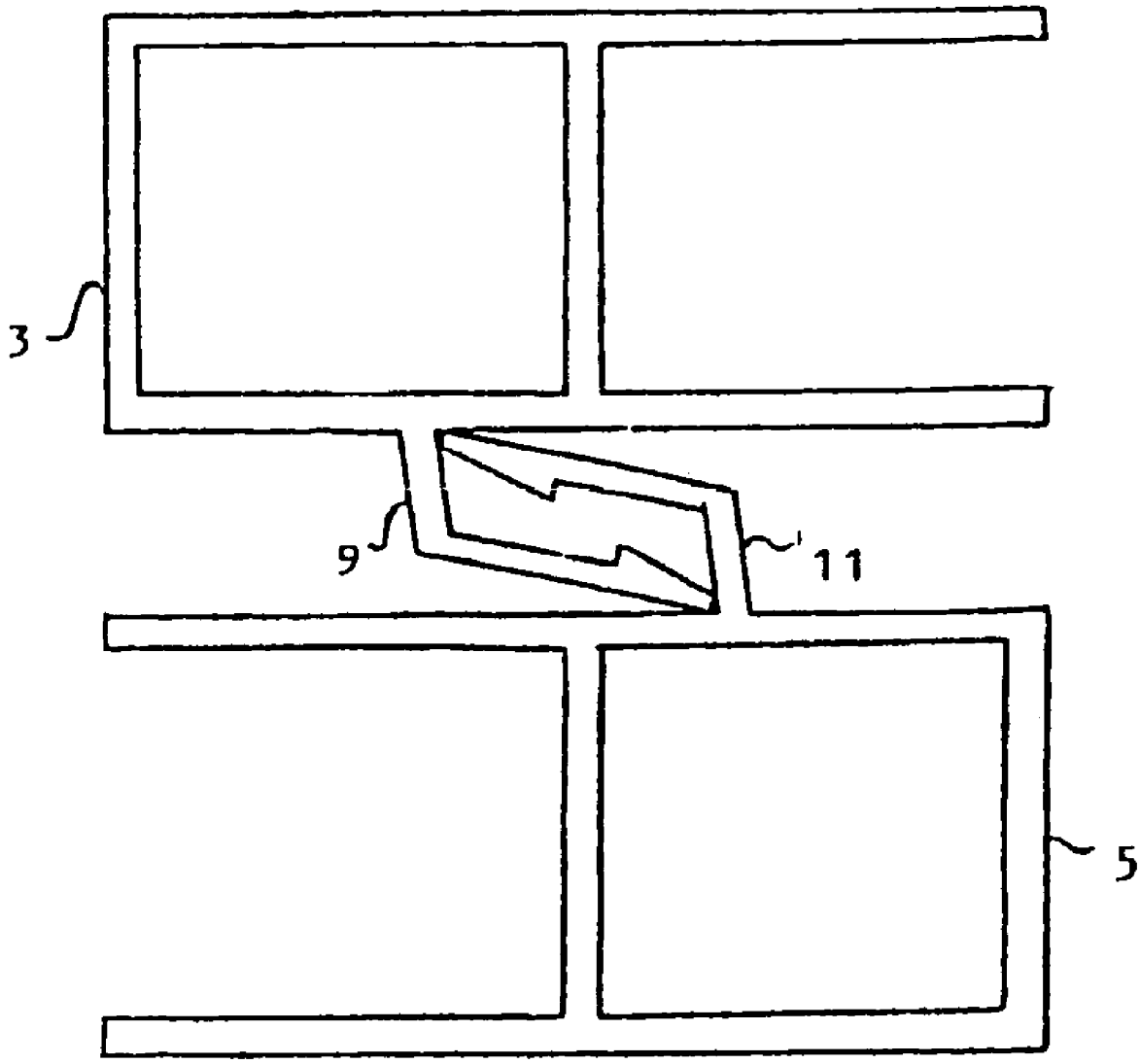
FIG. 4 shows the catch of FIGS. 1 to 3 which has been pried open.

FIG. 4 shows the catch where the force applied to the catch members has exceeded the elasticity or plastic deformation limit and the catch members have permanently deformed; the catch members will no longer revert to their original shapes. This permanent deformation of the catch members also prevents the door from being opened.

As has been previously described, preferably the doors have been provided with a plurality of catches. Only the catches at the point where the force is applied will deform. Therefore, only a small part of the door will have catches which have plastically deformed. However, this deformation in or along just a small part of the door or door frame prevents the door from opening.

Figure 5:
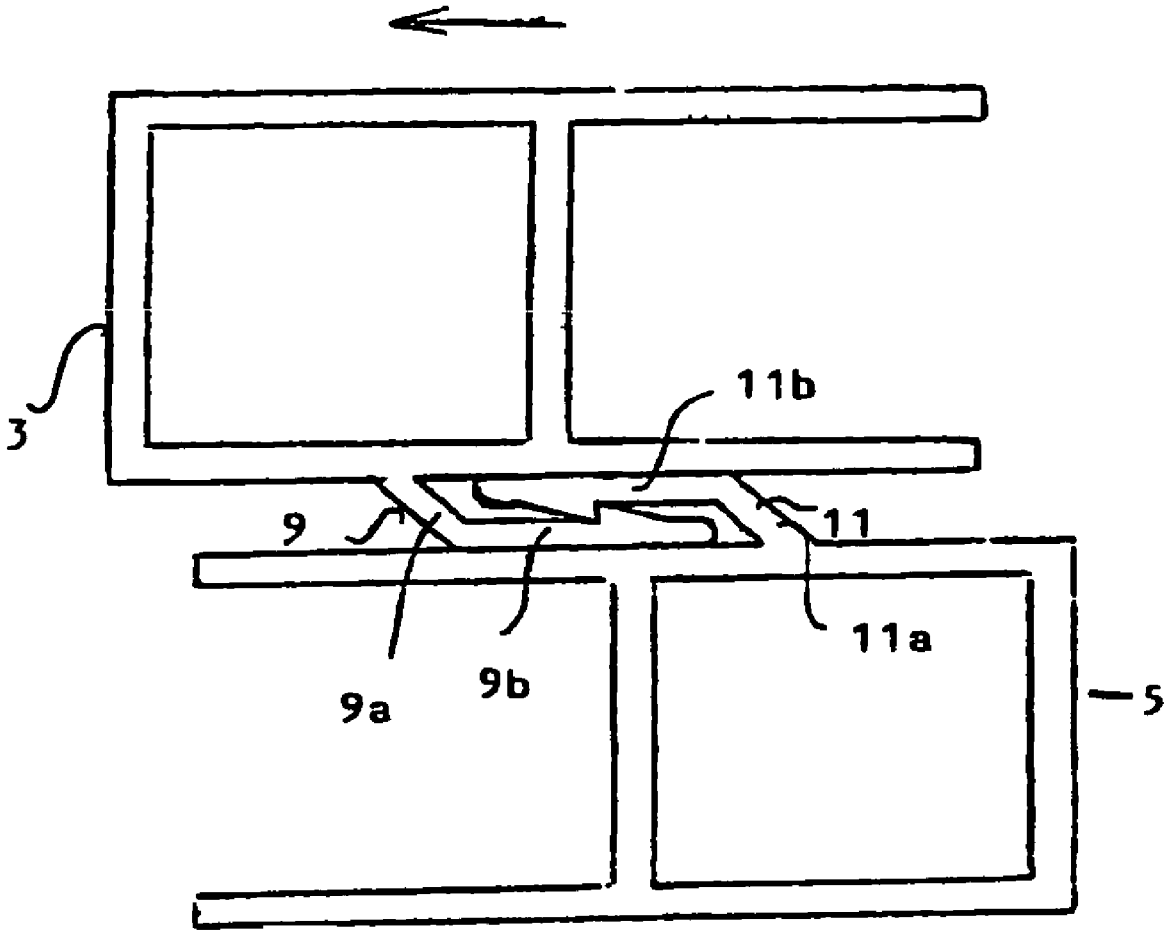
FIG. 5 shows the catch of FIGS. 1 to 4 which has been squashed or pressed together.

FIG. 5 shows a further safety feature of the catch. In this case, instead of a force being applied to the catch or to the sliding member where it attaches to the catch, a force has been applied to the side or end of the sliding members which is opposite the catch. This force causes the sliding members 3 and 5 to be pushed together, pushing the catch members 9 and 11 together, causing the catch members to plastically deform. Here, the deformation is seen to occur in the shorter parts of the L shaped shafts 9*a* and 11*a*, as opposed to the longer parts of the shafts 9*b* and 11*b*.

Figure 6:
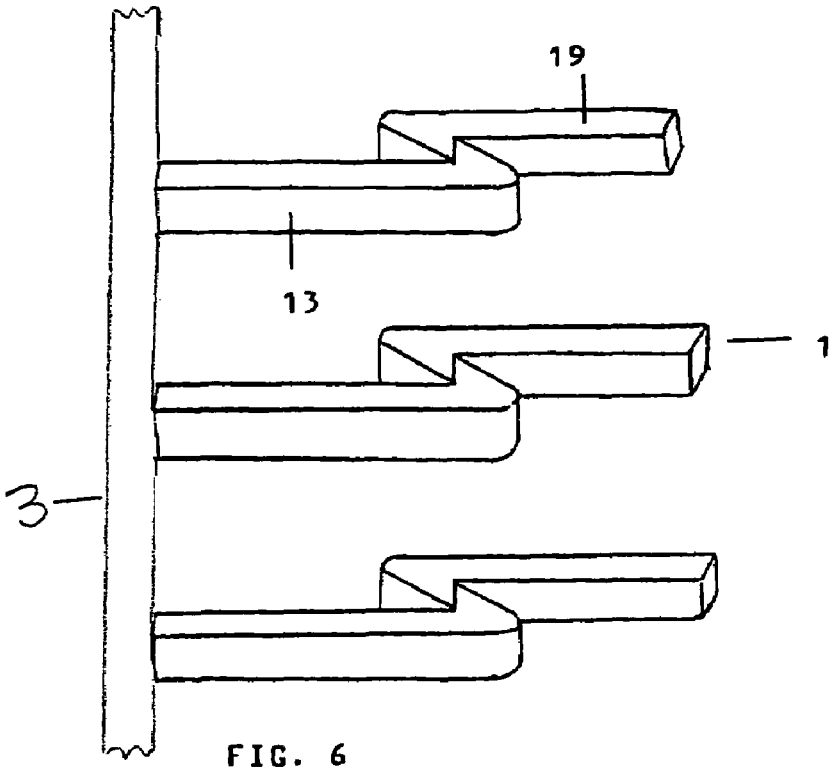
FIG. 6 shows two members which are slidable relative to each other with a plurality of catches in accordance with the present invention.

It will be preferred for the doors or other sliding members 3, 5 to be provided with a plurality of catches of the type shown in FIGS. 1 to 5. This is schematically shown in FIG. 6. Here, only a part of the L shaped shaft 13, 19 is shown. If one of the catch members opens, the other catch members should remain shut, thus preventing the members 3, 5 from being pried apart.

Figure 7:
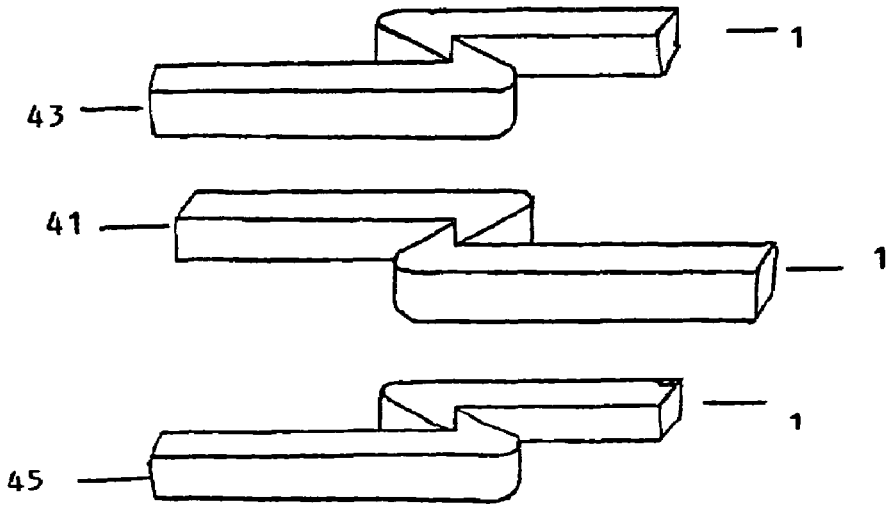
FIG. 7 shows two slidable members with a plurality of catches alternatively arranged in opposite directions.

It will be appreciated that there are preferential directions for providing the pried force. FIG. 7 shows an arrangement wherein the catches 1 are alternatively arranged such that the middle catch 41 is oppositely orientated with respect to adjacent catches 43, 45. Middle catch 41 is a mirror image through the center of the catch 1 about the abutting surfaces 29, 31. This catch provides a very strong lock as there is no single preferential direction for applying prying force for all of the catches.

Figure 8:
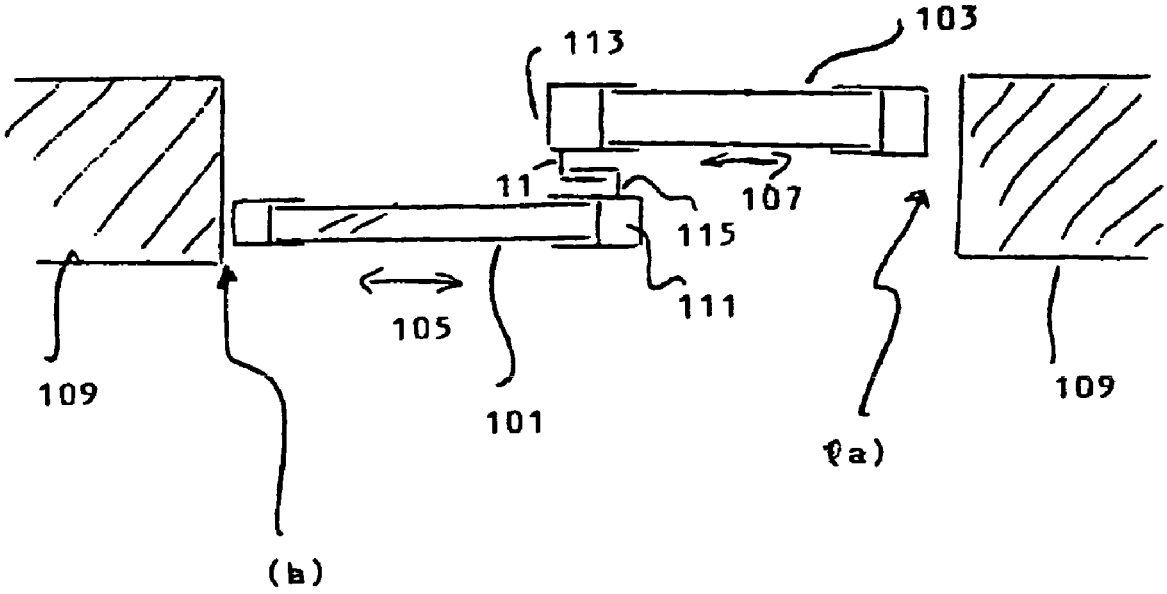
FIG. 8 shows a schematic plan view of the catch shown in FIGS. 1 to 5 applied to sliding windows.

FIG. 8 shows a sliding window arrangement. Window panes 101 and 103 can slide in directions 105 and 107. The window panes are supported by window frame 109. The window is shut when the window panes 105 and 107 are positioned so that they occupy the whole of the area defined by window frame 109. The furthest end 111, 113 of window panes 103, 101 from the window frame 109 when the window is in the closed position each have a catch member 115, 117 of the type described with reference to FIGS. 1 to 5. Ideally, there is a plurality of catch members. However, for simplicity, only one catch member is shown here. The window locks by moving the relative position of catch members 115, 117 into the locked position (FIG. 2) such that the projections (not shown) on the catch members 115, 117 are inter-engaged.

If a trespasser attempts to get into the windows by prying open the furthest points of the panes 111, 113, then the catch members 115, 117 flex apart in the manner shown in FIG. 3. However, if a force is applied where the window pane meets the frame 109, then this causes the catch members 115, 117 to be pushed together in the manner shown in FIG. 5.

Figure 9:
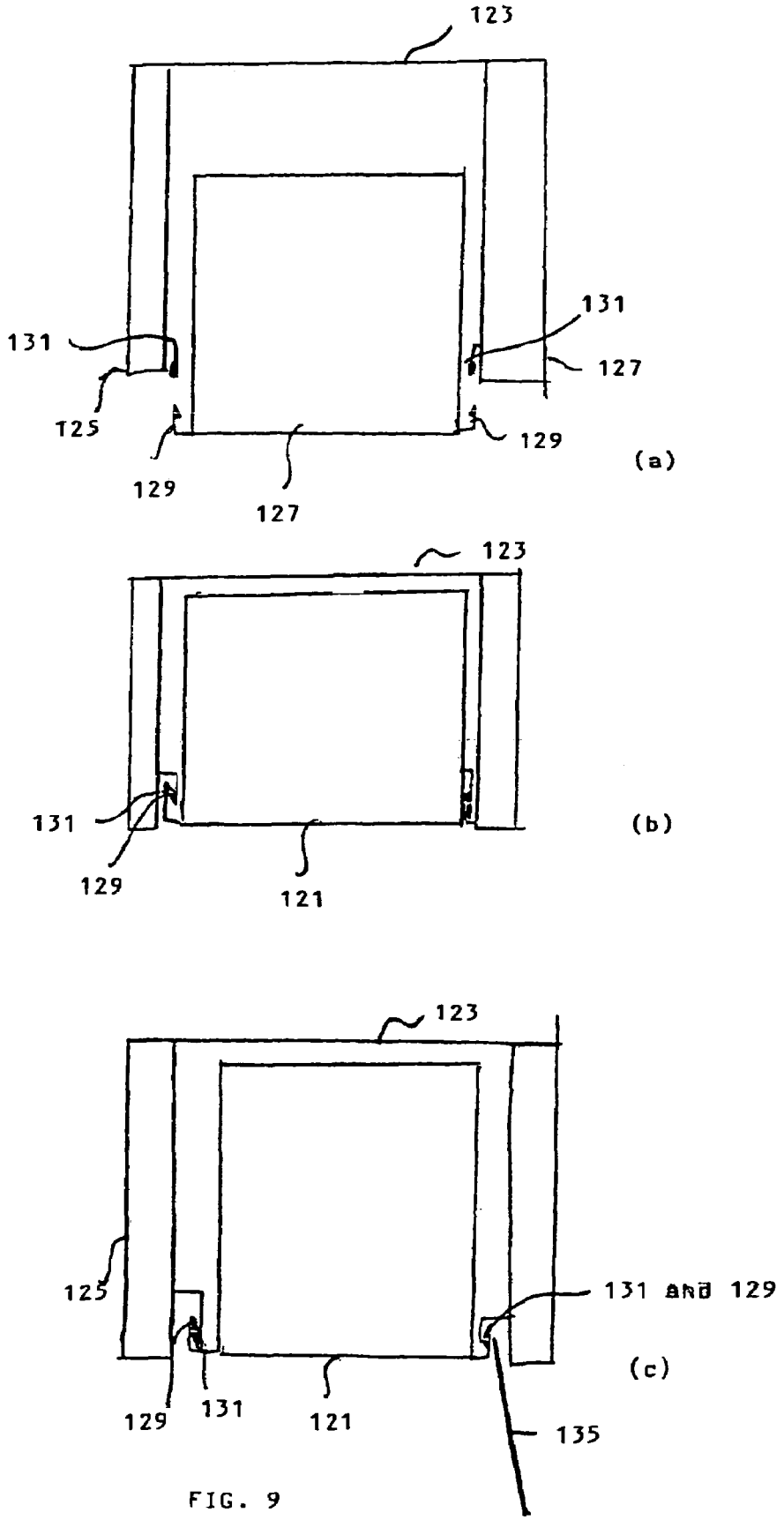
FIGS. 9(*a*), (*b*) and (*c*) show a drawer using the catch of FIGS. 1 to 5.

FIGS. 9(*a*)-(*c*) show the catch of the present invention applied to a drawer. The drawer 121 is slidable relative to a housing 123, for example, a cabinet, a desk, a shelf, etc. The housing has drawer supports 125 and 127; a first catch member is located on both of the supports 125, 127. However, for simplicity, the interaction of the drawer with only one of the catch members will be described. The drawer 121 is provided with a catch member 129 which is intended to interlock with catch member 131 provided on support 125. The catch member 129 is provided on the side of the drawer 121 close to the front end of the drawer. The front end of the drawer 121 is defined as the end of the drawer which is visible when the drawer is shut. To shut the drawer, it is pushed backwards into the housing 123. When the drawer 121 is pushed into the closed position, the catch members 129 and 131 inter-engage on both sides of the drawer, thus preventing removal of the drawer.

FIG. 9*b* shows the drawer in the closed position within the housing 123. The catch can be configured so that the projections 129 and 131 automatically engage when the drawer 121 is pushed into position. Alternatively, a lock member or some other lock mechanism may be provided so that the catch members 129 and 131 only inter-engage when the lock is activated.

FIG. 9*c* shows a screwdriver or other such implement being inserted into the catch mechanism to try to force open the drawer. The screwdriver 135 causes the right-hand catch members 131 and 129 to inter-engage more strongly. The drawer is pushed in the direction of the left-hand support 125 and the catch members 129 and 131 on the right-hand side inter-engage more strongly and securely. As the drawer is pushed towards support 125, the left-hand catch members 129 and 131 are also inter-engaged more strongly. If the force applied to the drawer by screwdriver 135 is strong enough, at least one of the catch members 129, 131 will plastically deform.

FIGS. 10*a* to 10*c* show the present invention applied to a hinged door. FIG. 10*a* shows a hinged door 201 which is hingeably connected to fixed support 203. The door is closed when it is in line with fixed support 205. The free end of the door 201, i.e., the end of the door which is opposite to a hinge 207 is provided with a first catch member 209. A second catch member 211 is provided on support 205.

FIG. 10*b* shows the door when it is shut. The catch members 209 and 211 interlock to cause the door 201 to be locked into position in line with support 205 and 203.

Figure 10:
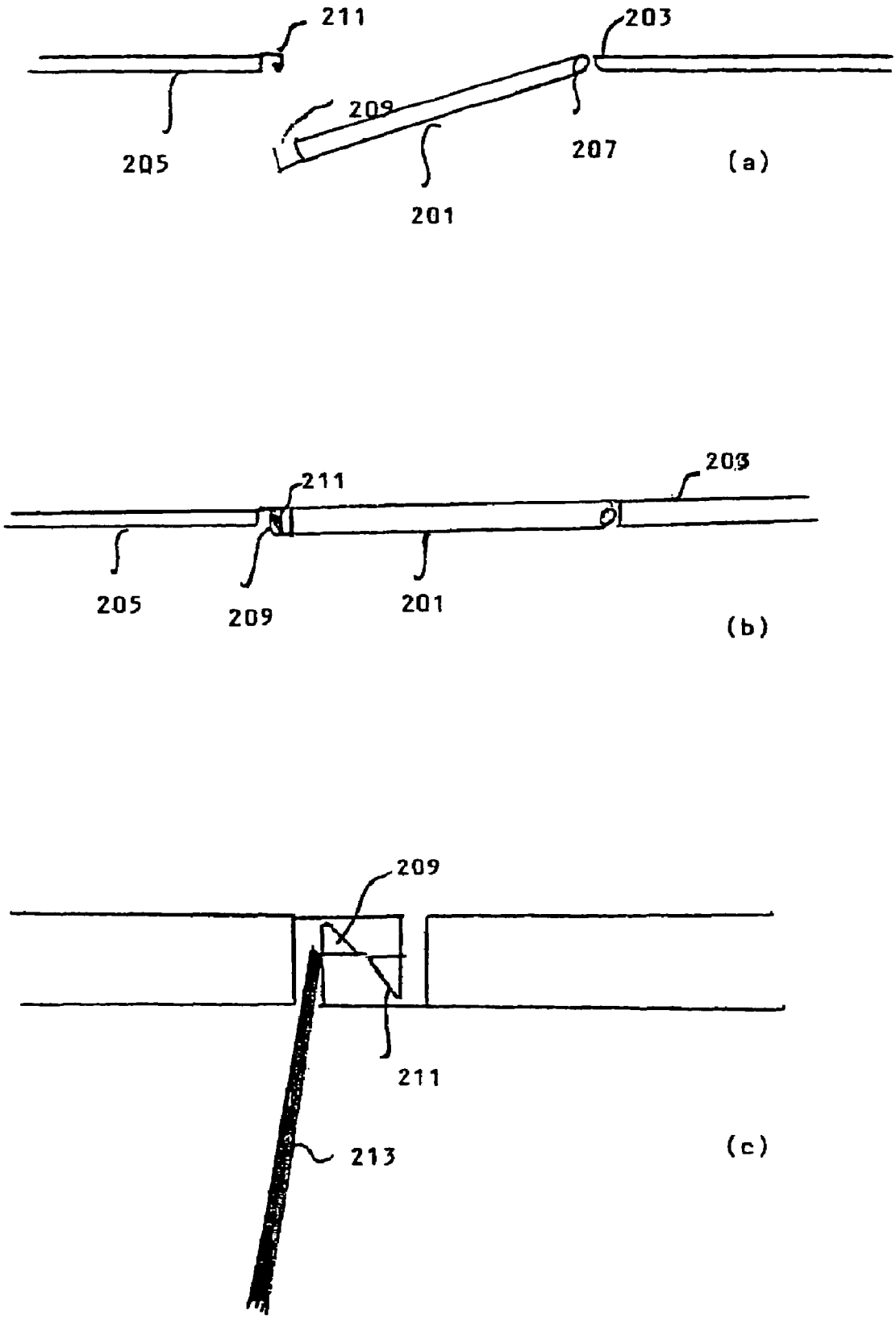
FIGS. 10(*a*), (*b*) and (*c*) show the catch of FIGS. 1 to 5 applied to a swinging door.

The catch members 209 and 211 may interlock as the door is put into the closed position. Alternatively, a further lock may be provided to cause projections on catch members 209 and 211 to inter-engage. A screwdriver 213 can be used to push members 209 and 211 into the locked position. As shown in FIG. 10(*c*), the screwdriver 213 cannot be used to pry open the catch members, as they will only be forced further into engagement by the prying of the screwdriver or other tool or implement. Eventually, the force will cause the catch members to plastically deform.

Figure 11:
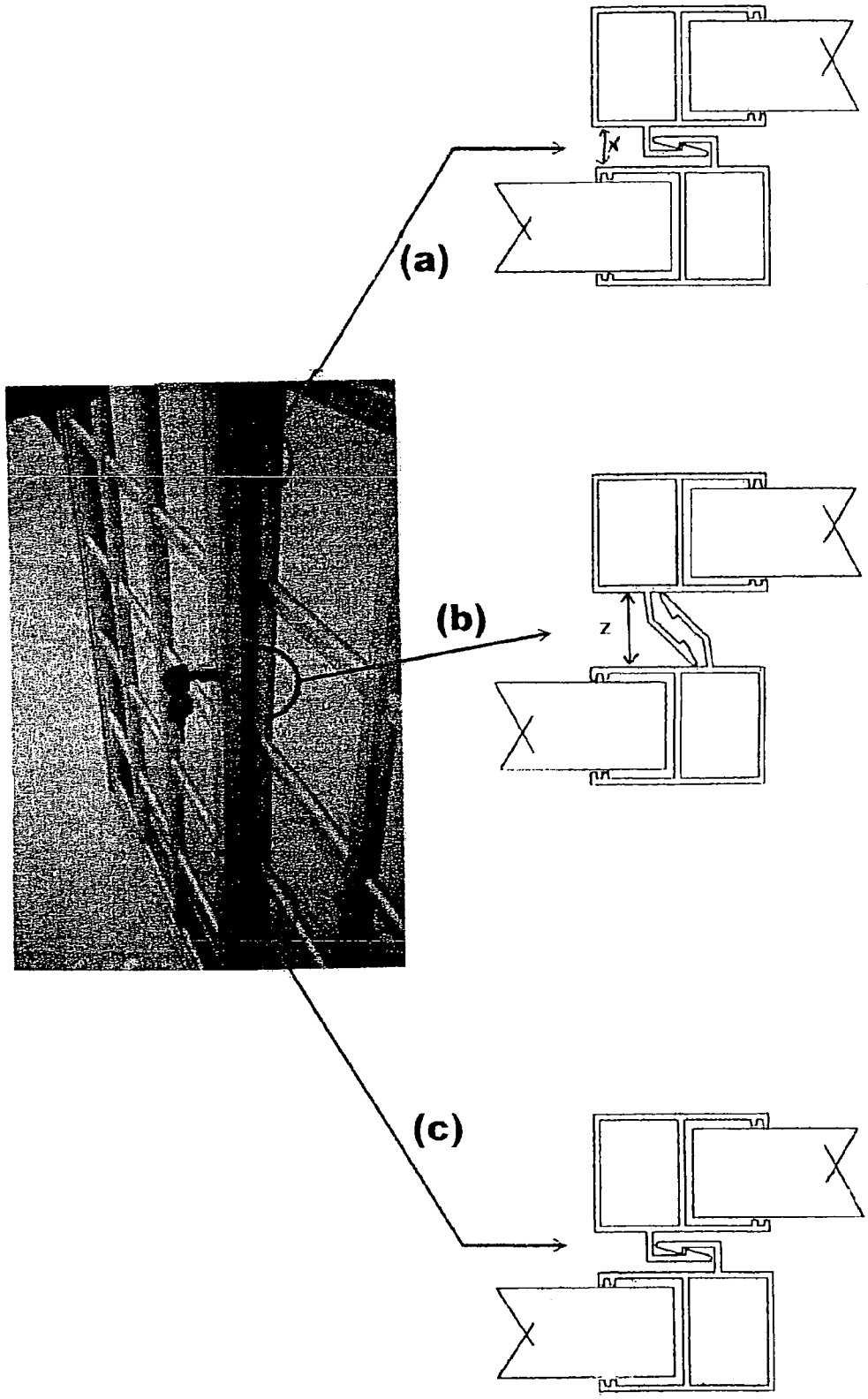
FIGS. 11(*a*), (*b*) and (*c*) show the catch of FIGS. 1 to 5.

FIG. 11 shows the catch assembly in locations (a), (b), and (c). After force is applied at location (b), the gap at catch (b) becomes narrower as shown in the figure. The gap (z) is wider than the gap (x) in FIG. 11(*a*) but smaller than the gap (y) shown in FIG. 3*a*. This will result in the catch in locations (a) and (c) being permanently locked.

The invention has been described with particular emphasis on the preferred embodiments. It should be appreciated that these embodiments are described for purposes of illustration only, and that numerous alterations and modifications may be practiced by those skilled in the art without departing from the spirit and scope of the invention. It is intended that all such modifications and alterations be included insofar as they come within the scope of the invention or the equivalents thereof.

I claim:

1. A catch assembly for securing first and second members, the first and second members being movable relative to each other between open and locked positions, and being separated from each other by a narrow space when in the locked position, the assembly comprising:

first and second flexible catch members being attached to the first and second members respectively, said first and second catch members being located in the narrow space between the first and second members, wherein said first and second catch members comprise an L-shaped shaft having a generally rectangular base and a generally rectangular height, said base having a free base end and an attached base end and said height having a free height end and an attached height end, said attached base end joined to said attached height end forming an "L" shape, said free height end terminating in a projection, the height of the first catch member being generally parallel to the height of the second catch member and to the first and second members in the locked position, wherein when the first and second catch members are in a locked position, said projection of the first catch member engages said projection of the second catch member and said projection of the second catch member engages said projection of the first catch member, wherein said catch members are flexible in response to the insertion of a prying member into the narrow space between either of the first and second members and one of said shafts to attempt to pry the first and second members to the open position and for affecting an increase in the narrow space between said first and second members and the shaft of said catch members, and for flexing said projections towards each other for enhancing the engagement of said projections in response to the insertion of the prying member, wherein at least one of said first and second members slides relative to the other of said members and relative to said catch assembly, wherein each of the first member and the second member is selected from the group consisting of a sliding door, a sliding window, a sliding grille, a drawer, a hinged door, a hinged window and a hinged grille, and each shaft of said catch members is moveable through at least 25° from a rest position during flexing.

2. The catch assembly according to claim 1, wherein the shaft of each catch member can flex away from the shaft of the opposing catch member as the catch members are moved apart.

3. The catch assembly according to claim 1, wherein the catch members comprise a material selected from the group consisting of metal and plastics.

4. The catch assembly according to claim 3, wherein the catch members comprise at least one material selected from the group of materials consisting of UPVC, aluminum, iron and stainless steel.

5. The catch assembly according to claim 1, wherein the shaft of each catch member moves angularly as it flexes.

6. The catch assembly according to claim 1, wherein the shaft of each catch member can flex such that the angle at the corner of each L-shaped shaft is varied as the catch members are moved apart or towards each other.

7. The catch assembly according to claim 1, comprising at least two first catch members located on opposing sides of the first member.

8. A hinged member assembly, comprising first and second members wherein the first member is a hinged member and is securable in a closed position to the second member, the assembly further comprising a catch assembly for securing the first and second members together, wherein the catch assembly is a catch assembly according to claim 1.

9. The hinged member assembly according to claim 8, wherein the first member is a hinged door, hinged window or hinged grille.

10. The catch assembly according to claim 1, wherein said catch members are constructed of a material having an elastic limit for preventing the catch members from returning to their original position and for preventing the movability of the members relative to each other when the catch members are moved far enough to cause the catch members to exceed the elastic limit.

11. The catch assembly according to claim 3, wherein the catch members comprise a material having a Young's modulus of at least $62GNm^{-2}$ ($9\times10^6$ psi).

12. The catch assembly according to claim 11, wherein the catch members comprise a material having a Young's modulus of at least $103GNm^{-2}$ ($15\times10^6$ psi).

13. The catch assembly according to claim 12, wherein the catch members comprise a material having a Young's modulus of at least $138GNm^{-2}$ ($20\times10^6$ psi).

* * * * *